US006895689B2

(12) United States Patent
Ueno

(10) Patent No.: US 6,895,689 B2
(45) Date of Patent: May 24, 2005

(54) DRYING SYSTEM

(76) Inventor: Makoto Ueno, 4-7, Yahata 1-chome, Tagajo-shi, Miyagi 985-0874 (JP)

( * ) Notice: Subject to any disclaimer, the term of this patent is extended or adjusted under 35 U.S.C. 154(b) by 0 days.

(21) Appl. No.: 10/467,748

(22) PCT Filed: Feb. 15, 2002

(86) PCT No.: PCT/JP02/01308

§ 371 (c)(1),
(2), (4) Date: May 25, 2004

(87) PCT Pub. No.: WO02/065041

PCT Pub. Date: Aug. 22, 2002

(65) Prior Publication Data

US 2004/0231183 A1 Nov. 25, 2004

(30) Foreign Application Priority Data

Feb. 15, 2001 (JP) ..... 2001-038495

(51) Int. Cl.[7] ..... F26B 3/34
(52) U.S. Cl. ..... 34/270
(58) Field of Search ..... 34/266, 270, 272

(56) References Cited

U.S. PATENT DOCUMENTS 5,070,625 A * 12/1991 Urquhart ..... 34/268
5,282,145 A * 1/1994 Lipson et al. ..... 700/208
5,456,023 A * 10/1995 Farnan ..... 34/270
5,555,649 A * 9/1996 Phillipson ..... 34/666
5,793,019 A * 8/1998 Boyle et al. ..... 219/400
6,062,850 A * 5/2000 Ino et al. ..... 432/143

FOREIGN PATENT DOCUMENTS

| | | |
|---|---|---|
| JP | 27-4598 | 5/1952 |
| JP | 50-28055 | 3/1975 |
| JP | 1-95282 | 6/1989 |
| JP | 2-131168 | 5/1990 |
| JP | 3-20296 | 2/1991 |
| JP | 6-137763 | 5/1994 |
| JP | 7-18192 | 3/1995 |
| JP | 7-328511 | 12/1995 |

* cited by examiner

*Primary Examiner*—Stephen Gravini
(74) *Attorney, Agent, or Firm*—Burr & Brown

(57) ABSTRACT

Disclosed is a drying apparatus for drying paints which includes a casing having an opening at one end, an infrared lamp provided in the casing and adapted to radiate infrared rays toward a painted surface, an electric fan for blowing air in the casing toward the painted surface, a circulation path for causing at least a part of the air blown toward the painted surface to flow into the casing again, an atmospheric air inlet for introducing atmospheric air into the casing, and a flow rate adjusting mechanism for adjusting the flow rate of the air flowing into the casing again. The drying apparatus makes it possible to shorten the requisite time for drying the painted surface and to obtain a high-quality painted surface.

10 Claims, 12 Drawing Sheets

DRYING SYSTEM

TECHNICAL FIELD

The present invention relates to a drying apparatus and, more specifically, to a drying apparatus suitable for use when drying paint applied to a vehicle body.

BACKGROUND ART

The painting operation when repairing a vehicle includes a process for drying the paint applied to the vehicle body. Usually, in this process, there is used an infrared drying apparatus which dries the painted surface by irradiating it with infrared rays, a hot air drying apparatus which dries the painted surface by blowing hot air against the painted surface or the like, achieving a reduction in operation time by forcibly drying the painted surface.

According to studies of the present inventors, etc., it has been found out that in order to efficiently dry the painted surface, the following conditions must be satisfied. A first condition is to quickly evaporate the solvent contained in the paint from the inside. A second condition is to quickly dissipate from the painted surface the solvent evaporated from the inside of the paint. A third condition is to quickly polymerize pigment, which is the main component of the paint. It has been found out that by satisfying such conditions, the drying time can be substantially shortened. It has also been found out that by satisfying these conditions, at the same time, it is possible to obtain a satisfactory painted surface free from defective drying.

Examples of defective drying include pin holes generated by insufficient degassing of the solvent and blister. The pin holes are referred to as voids generated in the painted surface by evaporation of the solvent remaining in the paint through breaking the coating film formed on the painted surface, when the film is formed on the surface in a state where degassing of the solvent is insufficient. Blister means local swelling of the painted surface as a result of bonding of the solvent remaining in the coating film with the water in the air after completing the drying of the painted surface.

However, the conventional drying apparatuses do not satisfy the above conditions to a sufficient degree. That is, in the infrared drying apparatus, drying (heating) is started from the inner side of the painted surface by infrared rays emitted from the apparatus. The solvent evaporated from the inside of the paint, however, remains on the painted surface in a calm state. Thus, evaporation of the subsequent solvent is hindered by the remaining solvent.

In the hot air drying apparatus, drying (curing) is started from the painted surface by hot air sent from the apparatus. Thus, prior to evaporation of the solvent contained in the paint, a coating film (drying film) is formed on the painted surface. Thus, evaporation of the solvent in the paint is hindered by the coating film (drying film) formed prior to the evaporation of the solvent.

In some hot air drying apparatuses, infrared rays are emitted when generating hot air. However, the contribution of the infrared rays to the drying of the painted surface is negligible as compared with that of the hot air. Thus, drying performed from the inner side of the painted surface by infrared rays is not to be expected.

DISCLOSURE OF THE INVENTION

It is an object of the present invention to provide a drying apparatus capable of substantially reducing the requisite time for drying a painted surface and making it possible to obtain a high-quality painted surface.

In accordance with the present invention, there is provided a drying apparatus characterized by comprising a casing having an opening at one end, an infrared radiation device for radiating infrared rays toward a painted surface through the opening, a blower for blowing air in the casing toward the painted surface through the opening, a circulation path for causing at least a part of the air blown toward the painted surface by the blower to flow into the casing again, an atmospheric air inlet for introducing atmospheric air into the casing, and a flow rate adjusting mechanism for adjusting the flow rate of the air flowing into the casing again by way of the circulation path.

In the drying apparatus of the present invention, constructed as described above, the casing wraps up the entire painted surface, which is the object of drying, and the infrared rays emitted from the infrared radiation device are radiated/absorbed with a uniform intensity with respect to the entire painted surface while repeating irregular reflection between the inner wall surface of the casing and the painted surface. Further, the infrared rays acts on the interior of the painted surface to heat the painted surface from inside. As a result, polymerization of the pigment contained in the paint is promoted and, at the same time, it becomes possible to promote evaporation of the solvent contained in the paint while suppressing formation of an unnecessary coating film (drying film) that hinders evaporation of the solvent.

Further, the drying apparatus of the present invention is provided with a circulation path and a blower creating a circulation flow, so that the solvent evaporated from the paint is quickly dissipated by this circulation flow. The air circulating in the casing absorbs radiation heat from the painted surface, etc. to gradually undergo temperature rise. However, when the circulation rate of the air is lowered by the flow rate adjusting mechanism, the flow rate of the air introduced from the atmospheric air inlet to the interior of the casing becomes so much the higher, and the temperature in the casing is lowered. Thus, the unnecessary heating of the painted surface by the circulation flow is restrained, whereby an ideal drying condition is attained.

It is possible for the flow rate adjusting mechanism of the present invention to enlarge and contract the passage section of the circulation path to thereby effect flow rate adjustment on the air flowing through this circulation path.

Further, the casing of the present invention may comprise an inner casing having a built-in infrared radiation device to form an infrared radiation portion, an outer casing wrapping up the inner casing from outside while maintaining a predetermined gap between it and the surface of the inner casing, and a communication path communicating the predetermined gap with the space formed inside the inner casing, wherein the predetermined gap constitutes a part of the circulation path.

In this casing constructed as described above, a part of the circulation path is secured inside the casing. Thus, it is possible to reduce the passage length of the circulation path to a requisite minimum, whereby it is possible to achieve a reduction in the size and weight of the apparatus. Further, the temperature change in the circulation path due to the temperature change of the atmospheric air is reduced, thus facilitating the temperature control of the interior of the casing by the flow rate adjusting mechanism.

Further, regarding the flow rate adjusting mechanism, there is provided, in accordance with the present invention, an extendable adjuster connecting the inner casing and the outer casing to each other, the passage section of the circulation path being expanded and contracted by varying the total length of this adjuster.

In the flow rate adjusting mechanism thus constructed, the passage sectional area of the circulation path formed between the inner casing and the outer casing is varied by changing the total length of the adjuster as desired. That is, when the adjuster is extended, the passage section of the circulation path is expanded, and when the adjuster is contracted, the passage section of the circulation path is contracted. Thus, the circulation rate of the air circulating in the casing can be arbitrarily adjusted.

Further, regarding the flow rate adjusting mechanism, in accordance with the present invention, the atmospheric air inlet can be provided in the route of the circulation path. Further, the flow rate adjusting mechanism may be constructed such that, by enlarging and contracting the opening area of the atmospheric air inlet, the flow rate of the air flowing into the casing again by way of the circulation path is adjusted.

In the flow rate adjusting mechanism thus constructed, atmospheric air (fresh air) is introduced into the circulation path, and the total amount of air circulating in the casing is reduced. That is, in the present invention, the air flowing into the casing again does not indicate the total amount of air flowing into the casing by way of the circulation path, but is defined by the amount of existing air contained in the air, that is, the amount of air flowing into the casing again by way of the circulation path after being blown toward the painted surface.

Further, the drying apparatus of the present invention may comprise a temperature detection sensor for detecting the temperature of the air blown toward the painted surface, and a control device for performing air amount adjustment for the blower on the basis of the air temperature detected by the temperature detection sensor, in which the control device increases the output of the blower when the temperature detected by the temperature sensor is higher than a target air temperature and decreases the output of the blower when the temperature detected by the temperature sensor is lower than the target temperature.

In this construction, the temperature of the air blown toward the painted surface is monitored by the temperature detection sensor, and the output value thereof is fed back for air amount control of the blower, whereby the temperature of the air blown toward the painted surface is controlled accurately. As stated above, the flow rate of the air flowing into the casing again by way of the circulation path is restricted by the flow rate adjusting mechanism. Thus, when the output of the blower is increased, the flow rate of the air taken in through the atmospheric air inlet increases, and the temperature of the air circulating in the casing is lowered. On the other hand, when the volume of air of the blower is decreased, the flow rate of the air taken in through the atmospheric air inlet is reduced, so that the temperature of the air circulating in the casing rises. Thus, by thus executing the air volume control, it is possible to maintain the air temperature substantially at a fixed value.

Regarding the infrared radiation device of the present invention, it is desirable that the infrared rays emitted from the infrared radiation device be one having a wavelength range including a range of 2.5 $\mu$m to 14.0 $\mu$m. Further, the peak of the radiation energy of the infrared rays emitted from the infrared radiation device is preferably in a wavelength range of 3.0 $\mu$m to 4.0 $\mu$m. It is also possible for the peak of the radiation energy of the infrared rays emitted from the infrared radiation device to be in a wavelength range of 5.5 $\mu$m to 10.0 $\mu$m. It is desirable that the peak of the radiation energy be defined in a range where the radiation energy (radiation rate) of the infrared rays emitted at a predetermined output exceeds 50% and, more preferably, 70%.

The wavelength range including the range of 2.5 $\mu$m to 14.0 $\mu$m corresponds to wavelengths that paints (pigments) widely adopted in usual painting operations, such as methyl methacrylate resins, epoxy resins, phenol resins, urea resins, and melamine resins, are most ready to absorb. That is, when the infrared radiation device actively emits infrared rays of wavelengths suitable for absorption by these various kinds of resins, the heating time for the paint, that is, the drying time, is substantially shortened.

Further, the above-mentioned pigments have absorption spectrum peaks in the wavelength range of 3.0 $\mu$m to 4.0 $\mu$m and the wavelength range of 5.5 $\mu$m to 10.0 $\mu$m. Thus, when the radiation energy peak is set in these wavelength ranges, the infrared rays emitted from the infrared radiation device are absorbed more efficiently, and the paint can be dried (heated) in a shorter time. Incidentally, when infrared rays having a wavelength out of the range of 2.5 $\mu$m to 14.0 $\mu$m are emitted, the infrared rays are scarcely absorbed by the above resins, extending the infrared rays emission time (heating time) unnecessarily. Note that the above pigments have only been mentioned by way of example; the pigments suitable for the wavelength of 2.5 $\mu$m to 14.0 $\mu$m are not restricted to the above-mentioned ones.

Further, the drying apparatus of the present invention may be equipped with a support rack for supporting the casing. The support rack has a longitudinal frame and a lateral frame slidably held by the longitudinal frame, the casing being swingably held by the lateral frame. In this construction, the casing constituting the main portion of the drying apparatus can be easily supported at a desired position.

DETAILED DESCRIPTION OF THE INVENTION

Figure 1:
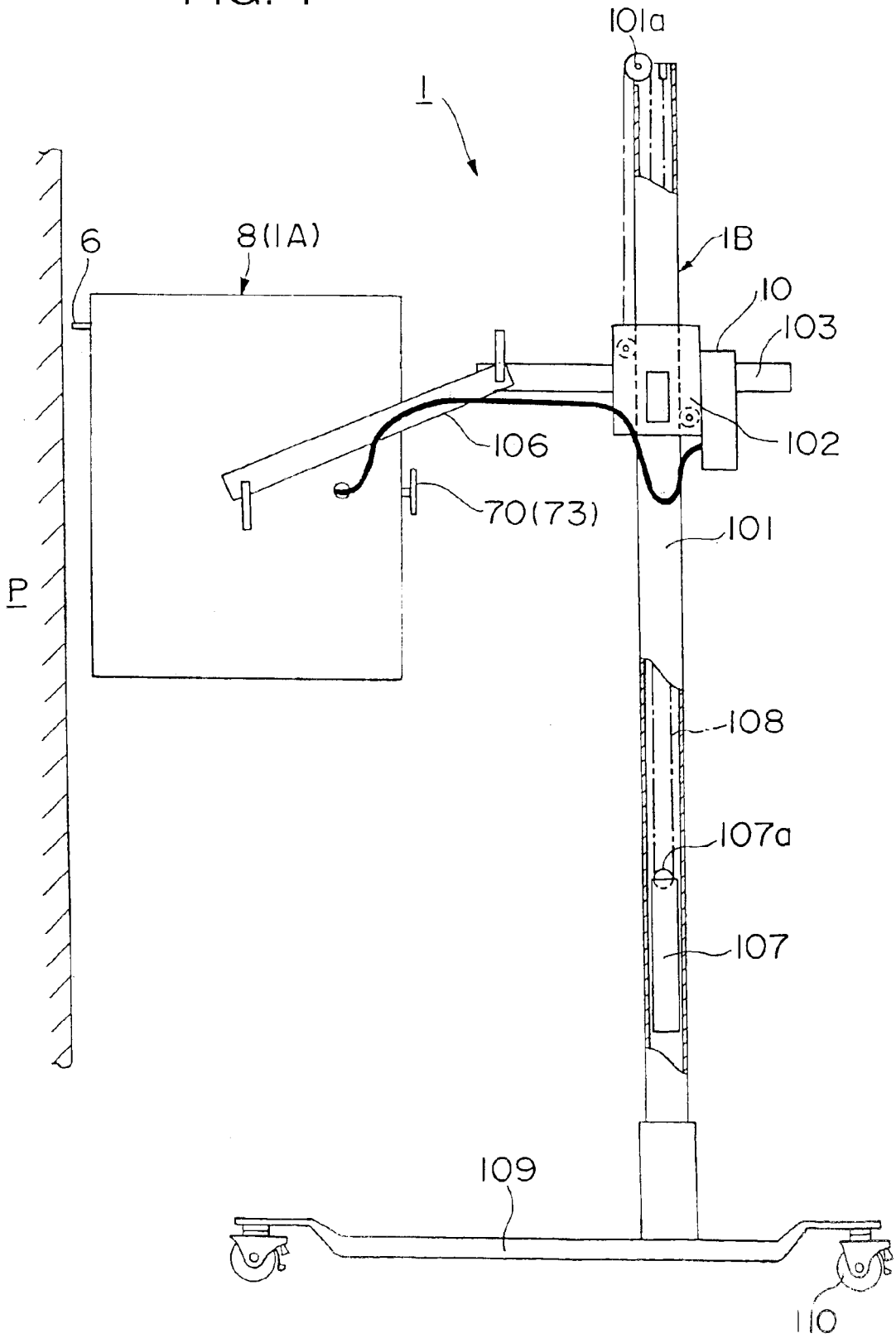
FIG. 1 is a side view of a vehicle drying apparatus according to an embodiment of the present invention.
Figure 2:
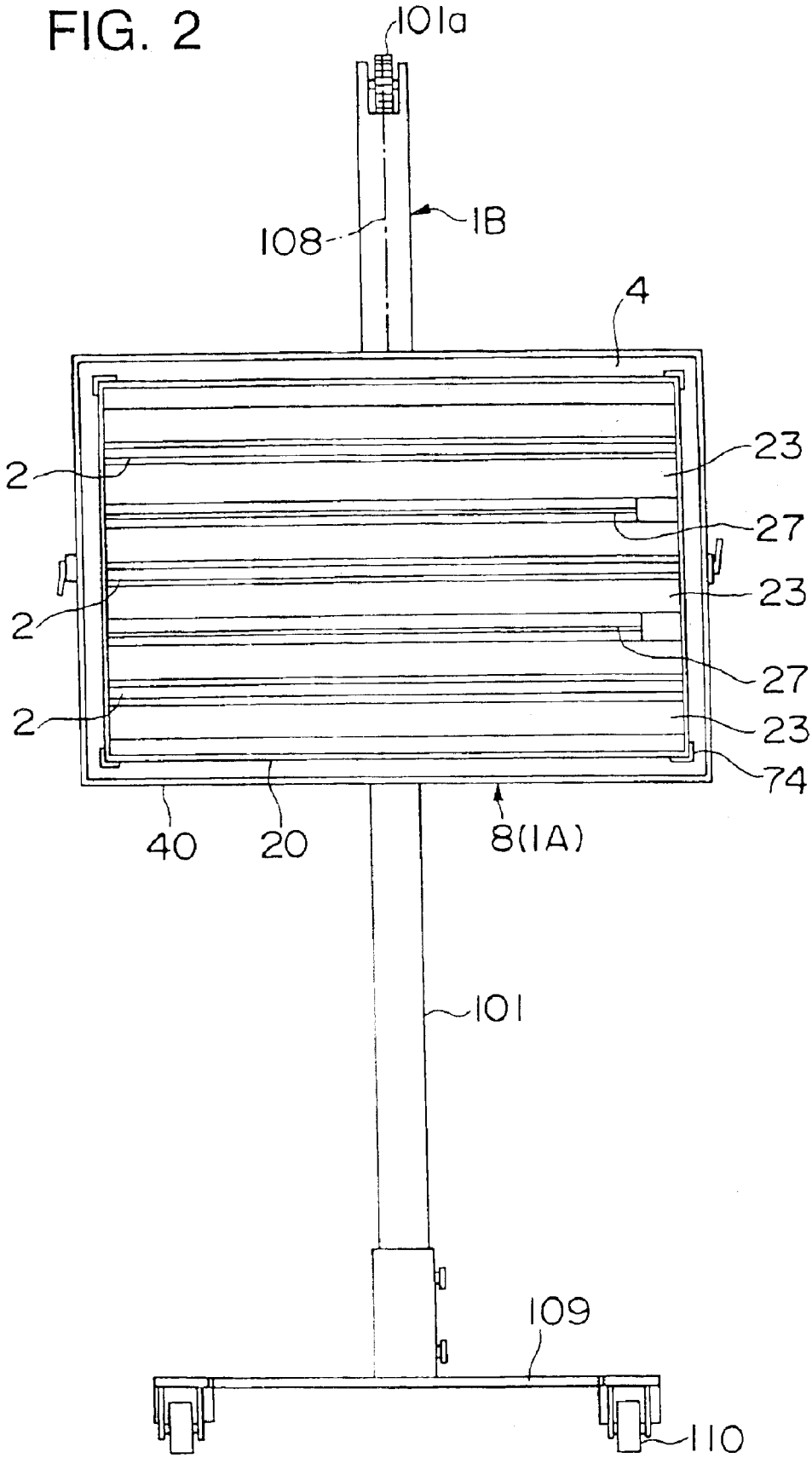
FIG. 2 is a front view of a vehicle drying apparatus according to the embodiment of the present invention.
Figure 3:
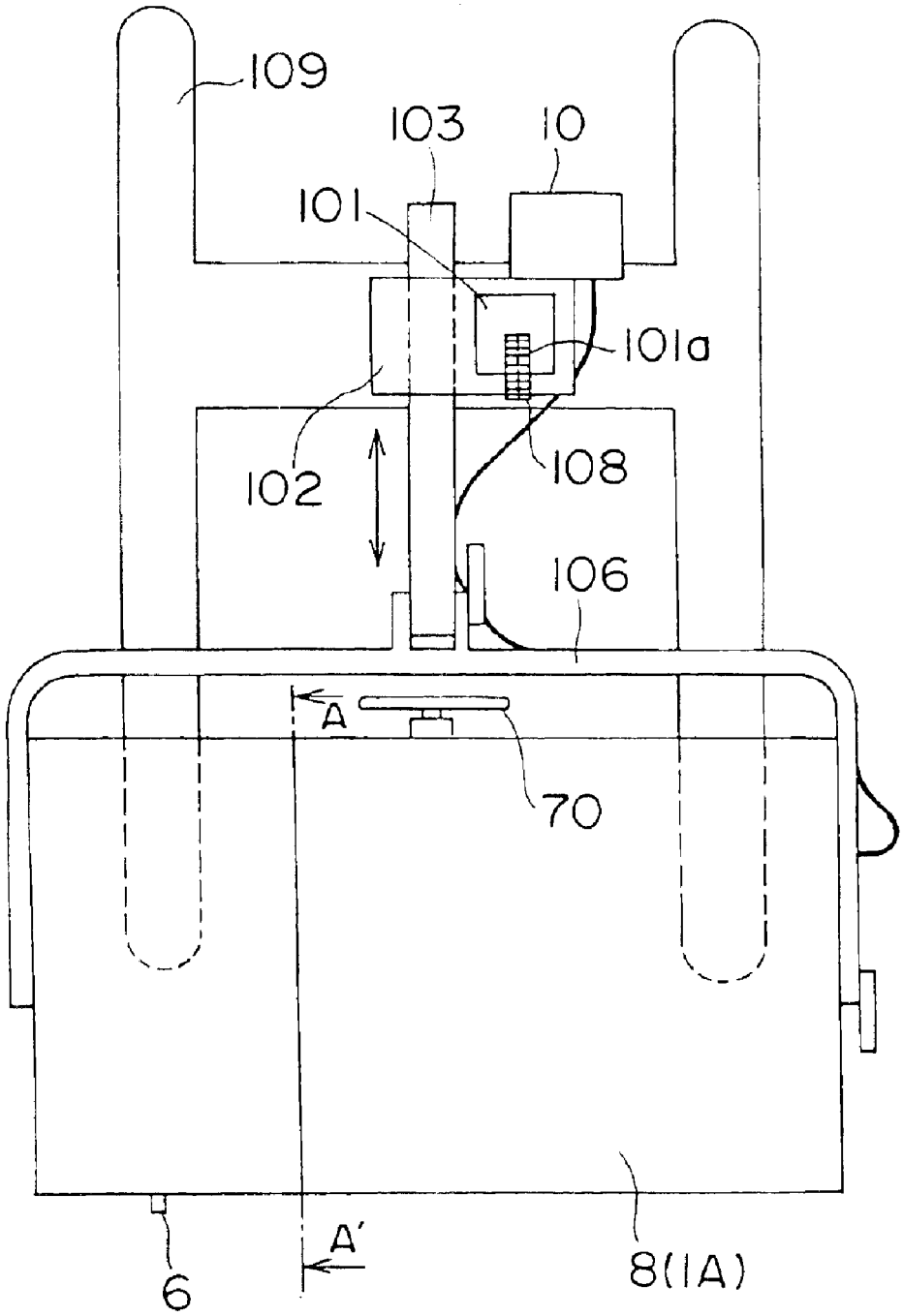
FIG. 3 is a plan view of a vehicle drying apparatus according to the embodiment of the present invention.

An example in which a drying apparatus of the present invention is applied as a vehicle drying apparatus will be described below with reference to the drawings.

First, the construction of a drying apparatus will be schematically described.

A drying apparatus of this embodiment (hereinafter referred to as the vehicle drying apparatus) 1 comprises a casing 8 containing infrared lamps 2, electric fans 3, etc. and constituting a main portion of the vehicle drying apparatus 1, a control system for controlling the infrared lamps 2, electric fans 3, etc., and a support rack 1B movably supporting the casing 8.

The casing 8 has a double structure consisting of an inner casing 20 and an outer casing 40. Provided in the inner casing 20 are the infrared lamps 2 for applying infrared rays to the painted surface P, the electric fans 3 for circulating the air in the casing 8 to promote the drying of the painted surface P, etc. That is, the casing 8 functions as an infrared drying device for drying the painted surface P mainly through infrared radiation.

Further, the casing 8 is equipped with an air circulation path 4, and a flow rate adjusting mechanism. The air circulation path 4 serves to repeatedly realize in the casing 8 a circulation flow formed through the operation of the electric fans 3. The flow rate adjusting mechanism serves to restrict the flow rate of air circulating in the casing 8 and to prevent excessive temperature rise of the air whose temperature rises in proportion to the infrared radiation time. In the following, each component will be described in detail.

In the following description, an entire casing containing the infrared lamps 2, the electric fans 3, etc. will be sometimes referred to as a drying apparatus main body 1A.

Figure 5:
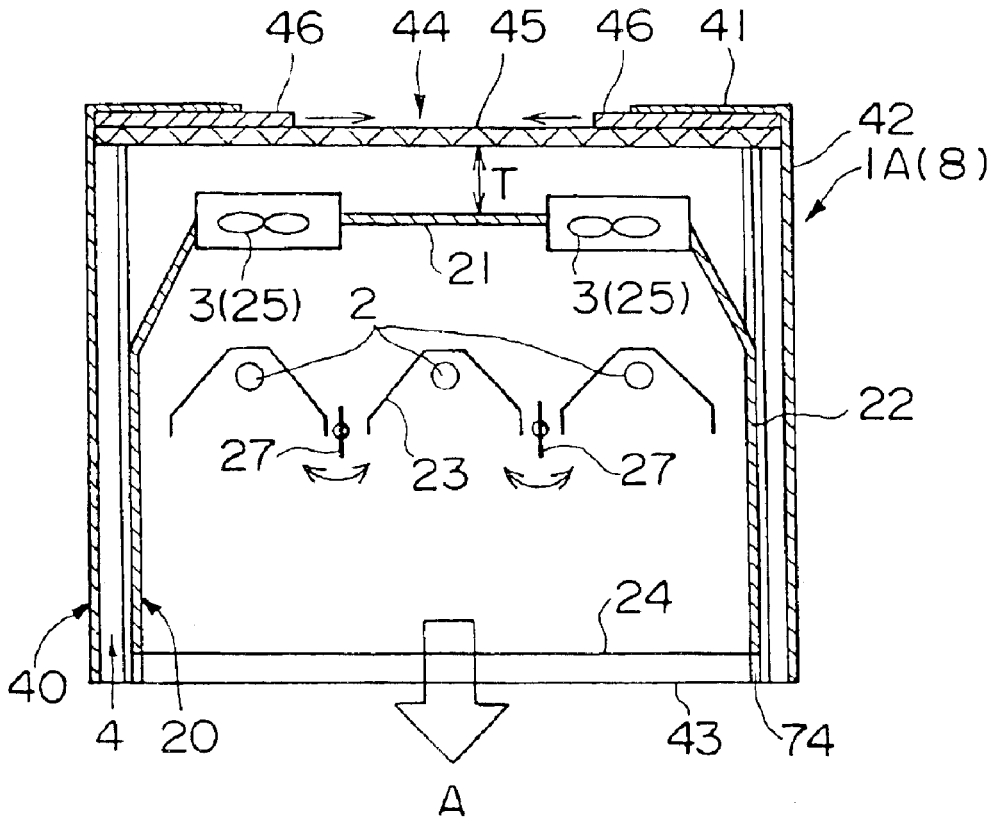
FIG. 5 is a sectional view taken along the line A–A' of FIG. 3.
Figure 6:
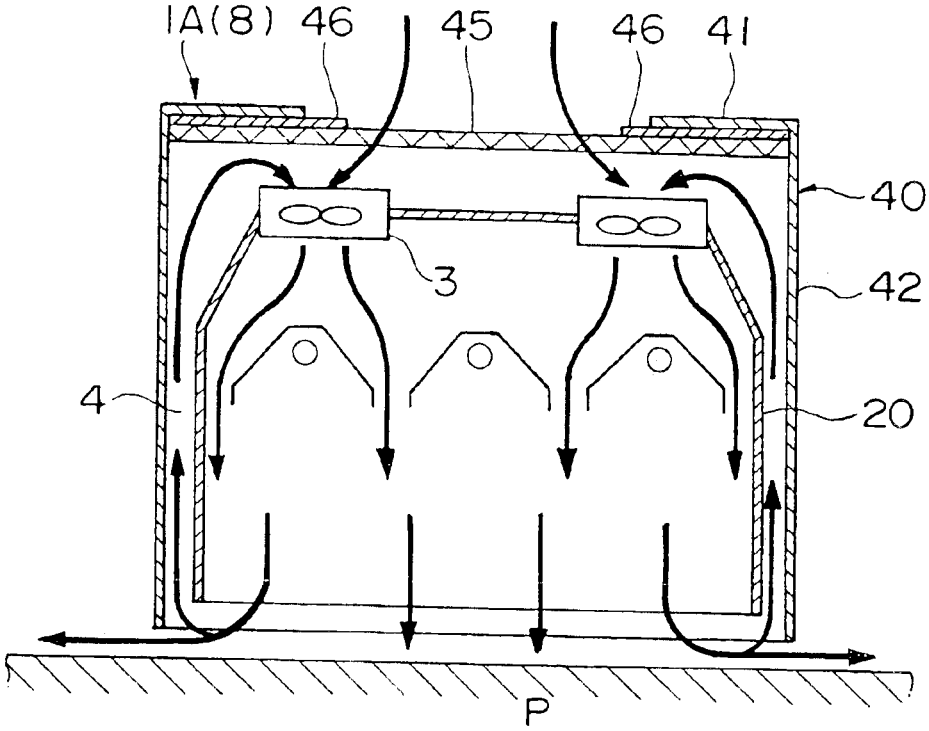
FIG. 6 is a diagram for illustrating the air flow in the casing.

As stated above, the casing 8 has the inner casing 20 in which the main components for drying, such as the infrared lamps 2 and the electric fans 3, are incorporated, and the outer casing 40 wrapping the inner casing 20 from outside while maintaining a predetermined gap between it and the inner casing 20, a part of the air circulation path 4 mentioned above being formed by the gap defined by the inner casing 20 and the outer casing 40 (See FIGS. 5 and 6).

Further, as shown in FIG. 5, the inner casing 20 has a rectangular top plate 21 and side wall plates 22 extending from the peripheral edges of the top plate 21, and is formed as a box with one end surface open. Further, in the interior of the box, three infrared lamps 2 are arranged in parallel and at equal intervals in a plane parallel to the top plate 21.

Further, each infrared lamp 2 is integrally provided with a reflection plate 23 surrounding it rearward and sidewise, and the infrared rays emitted from the infrared lamp 2 is efficiently reflected toward the opening side of the inner casing 20 (in the direction of the arrow A in FIG. 5). Both ends of each reflection plate 23 are secured to the side wall plates 22, and the positioning of each infrared lamp 2 in the casing 8 is effected by this reflection plate 23.

Each infrared lamp 2 consists of an infrared lamp adapted to actively emit infrared rays including the wavelength range of 2.5 $\mu$m to 14.0 $\mu$m. More preferably, an infrared lamp is adopted which has radiation energy peaks in the wavelength ranges of 3.0 $\mu$m to 4.0 $\mu$m and 5.5 $\mu$m to 10.0 $\mu$m, as indicated by the dotted line in FIG. 12. At the peaks, the output of the infrared lamp 2 exceeds 50% and, more preferably, 70%.

The wavelength of 2.5 $\mu$m to 14.0 $\mu$m coincides with the absorption spectrum of paints (pigments) widely adopted in usual painting operations, such as methyl methacrylate resins, epoxy resins, phenol resins, urea resins, and melamine resins. When infrared rays are actively radiated in this range, the absorption of infrared rays is effected efficiently.

Figure 12:
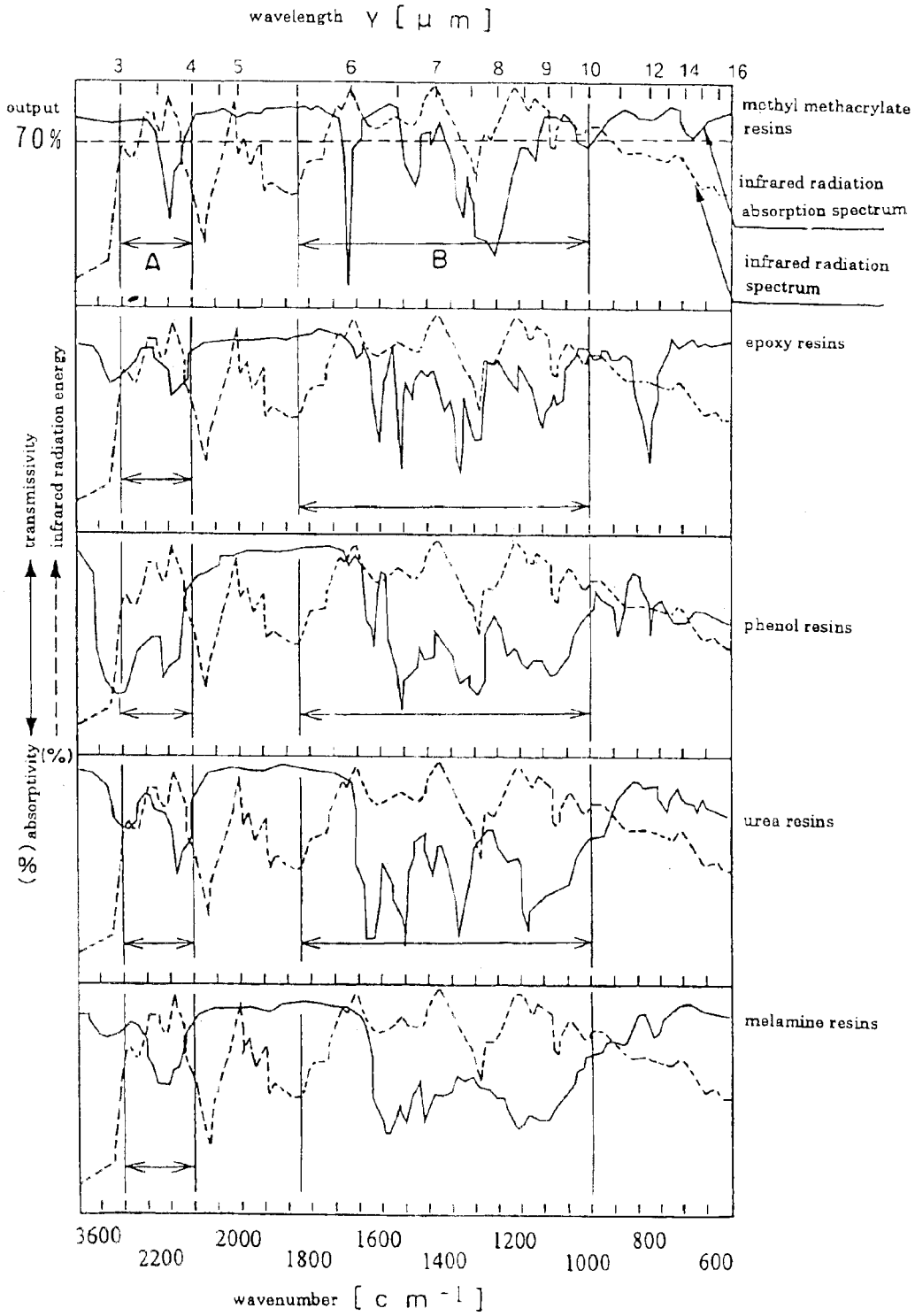
FIG. 12 is a diagram showing the correlation between the radiation spectrum of an infrared lamp according to an embodiment of the present invention and the absorption spectrum of a typical paint.

FIG. 12 is a graph showing the correlation between infrared radiation absorption spectrum (solid line) of each resin and the radiation spectrum of the infrared lamp 2 (dashed line). Regarding the infrared radiation absorption spectrum, the vertical axis of the graph corresponds to the infrared radiation absorptivity, and, regarding the infrared radiation spectrum, the vertical axis of the graph corresponds to the infrared radiation energy (radiant quantity). That is, the greater the difference (discrepancy) between the dotted line and the solid line, the larger the infrared radiation absorption quantity in the paint.

Various experiments show that, as shown in FIG. 12, the above-mentioned paints (pigments) most efficiently absorb infrared radiation in the range of 3.0 $\mu$m to 4.0 $\mu$m (indicated by the arrows A in FIG. 12) and the range of 5.5 $\mu$m to 10.0 $\mu$m (indicated by the arrows B in FIG. 12). In view of this, in this embodiment, the peaks of radiation spectrum are set in the wavelength range of 3.0 $\mu$m to 4.0 $\mu$m and the wavelength range of 5.5 $\mu$m to 10.0 $\mu$m, where the radiation is most readily absorbed by the paints, thereby achieving a further reduction in drying time.

Further, formed in the top plate 21 of the inner casing 20 are air inlets 25 (communication paths) for introducing air outside the inner casing 20 into the interior thereof. Further, the above-mentioned electric fan 3 (blower) is mounted to each air inlet 25. Further, between the above reflection plates 23, there are mounted electric motors (not shown) and current plates 27 driven by these electric motors.

Figure 4:
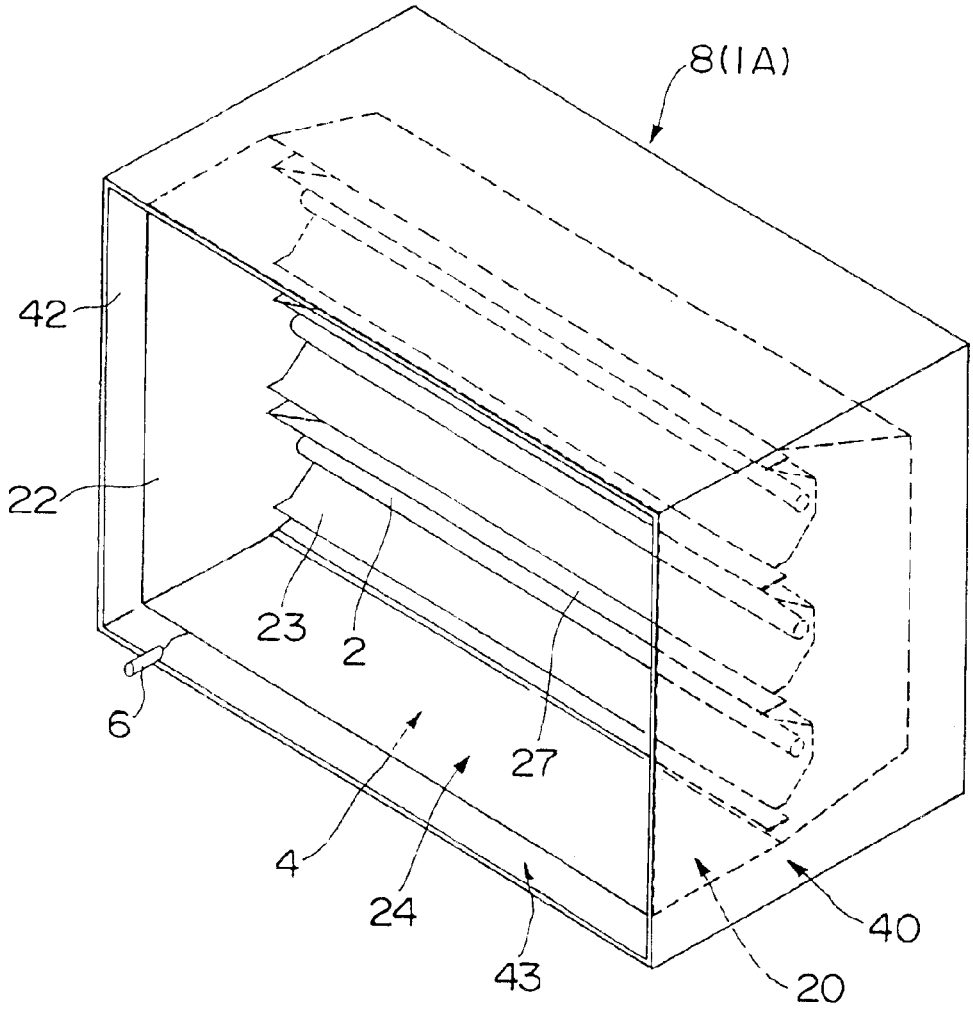
FIG. 4 is a perspective view of a vehicle drying apparatus according to the embodiment of the present invention as seen from the opening side.

Like the inner casing 20, the outer casing 40 is formed as a box composed of a top plate 41 and side wall plates 42, one end surface of the box being widely open in the same direction as the opening 24 formed in the inner casing 20 (See FIG. 4).

Note that, the side wall plates 42 are formed sufficiently longer than the side wall plates 22 of the inner casing 20, and, as shown in FIG. 5, the opening 24 formed in the inner casing 20 is somewhat retracted with respect to the opening 43 formed in the outer casing 40.

Further, an atmospheric air inlet 44 is formed in the top plate 41. The atmospheric air inlet 44 serves to introduce air outside the casing 8 (atmospheric air) into the casing 8 as needed. Further, mounted to the atmospheric air inlet 44 are a dust collection filter 45 for removing dust in the inflow air and flow rate adjusting plates 46 for adjusting the flow rate of the atmospheric air flowing through the atmospheric air inlet 44.

The flow rate adjusting plates 46 are provided so as to be slidable toward the inner side of the atmospheric air inlet 44, and the opening area of the atmospheric air inlet 44 can be arbitrarily adjusted by inwardly sliding the flow rate adjusting plates 46.

Further, the inner casing 20 and the outer casing 40 are connected to each other by an extendable adjuster 70. This adjuster 70 serves as a connecting member for effecting positioning on the outer casing 40 and the inner casing 20.

Figure 7:
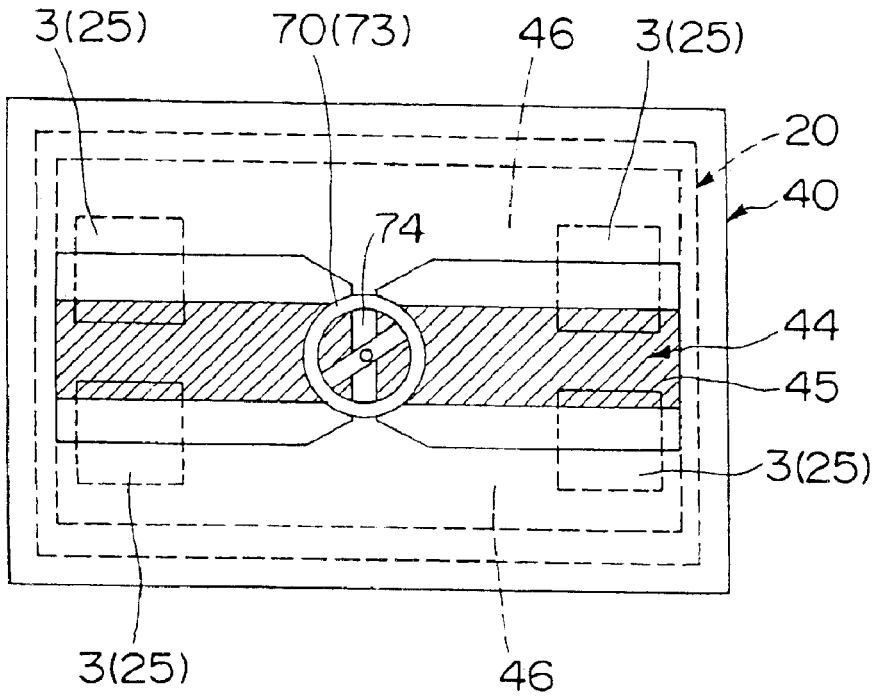
FIG. 7 is a plan view, as seen from the top plate side, of a casing according to an embodiment of the present invention.

Further, it also serves to vary the passage width T (passage section) of the circulation path 4 formed by the above inner casing 20 and outer casing 40. That is, the adjuster 70 serves as the flow rate adjusting mechanism of the present invention. In the following, this flow rate adjusting mechanism (adjuster 70) will be described with reference to FIGS. 7 and 8.

Figure 8:
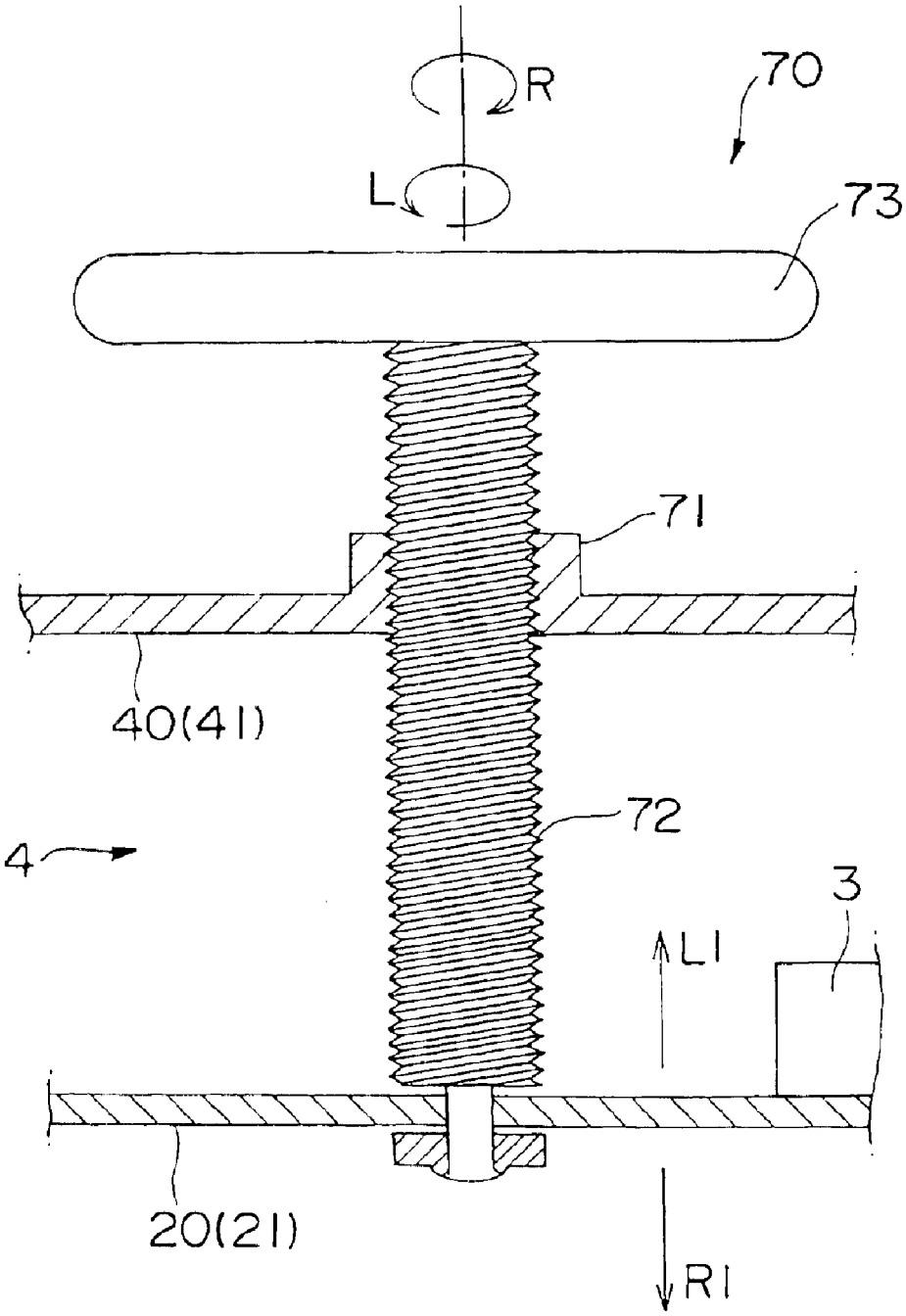
FIG. 8 is a partial sectional view of an adjuster according to an embodiment of the present invention.

As shown in FIG. 8, the adjuster 70 has a boss 71 welded to the top plate 41 of the outer casing 40 through a stay 75, a bolt 72 threadedly engaged with the boss 71, and an operating wheel 73 for rotating the bolt 72, the forward end portion of the bolt 72 being rotatably connected to the top plate 21 of the inner casing 20.

Further, in each corner portion of the inner casing 20, there is provided a guide rail 74 supported by the side wall plate 42 of the outer casing 40 and having an L-shaped sectional configuration. In this mechanism, when operating the adjuster 70, the inner casing 2 moves in the depth direction along this guide rail 74.

The relative positional relationship between the inner casing 20 and the outer casing 40 is determined according to the rotating direction of the operating wheel 73. That is, when, in FIG. 8, the operating wheel 73 is rotated in the direction of the arrow R, the inner casing 20 moves away from the outer casing 40 (i.e., moves in the direction indicated by the arrow R1). On the other hand, when, in FIG. 8, the operating wheel 73 is rotated in the direction of the arrow L, the inner casing 20 approaches the side of the outer casing 40 (i.e., moves in the direction indicated by the arrow L1). By thus providing the extendable adjuster 70 between the outer casing 40 and the inner casing 20, it is possible to arbitrarily change the passage width T (passage section) of the circulation path 4 formed between the outer casing 40 and the inner casing 20.

Next, the control system will be described.

The control system is equipped with an inverter (DC/AC converter), a timer, a CPU (microprocessor), a ROM (read only memory), a RAM (random access memory), a temperature sensor 6 (thermocouple thermometer), etc., executing sequence control of the infrared lamps 2 and the electric fans 3 on the basis of passage of time and feedback control related to air volume adjustment of the electric fans 3. The various kinds of components constituting the control system, such as the inverter, the timer, and the CPU, are accommodated in a control box 10 fastened to the support rack 1B. The temperature sensor 6 is mounted to the opening 43 (edge portion) of the outer casing 40.

Figure 10:
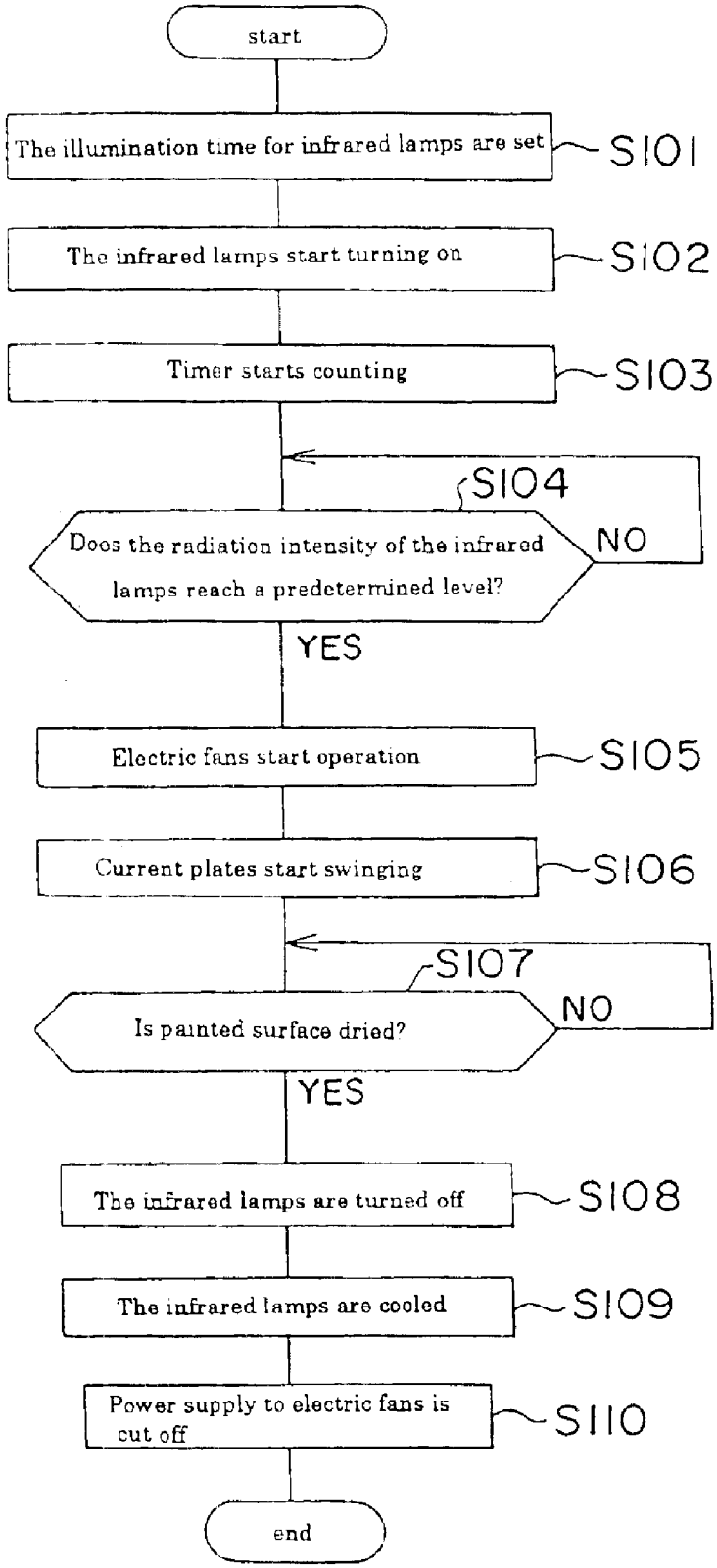
FIG. 10 is a flowchart for illustrating sequence control executed by a control system of a vehicle drying apparatus according to an embodiment of the present invention.

In the following, it will be described how to use the drying apparatus main body 1A (casing 8) and, at the same time, the sequence control (automatic control) executed by the control system, and the airflow formed in the casing 8 will be described in detail. As for the feedback control of the electric fans 3, it will be described in detail below. FIG. 10 is a flowchart illustrating the sequence control executed by the control system.

Figure 9:
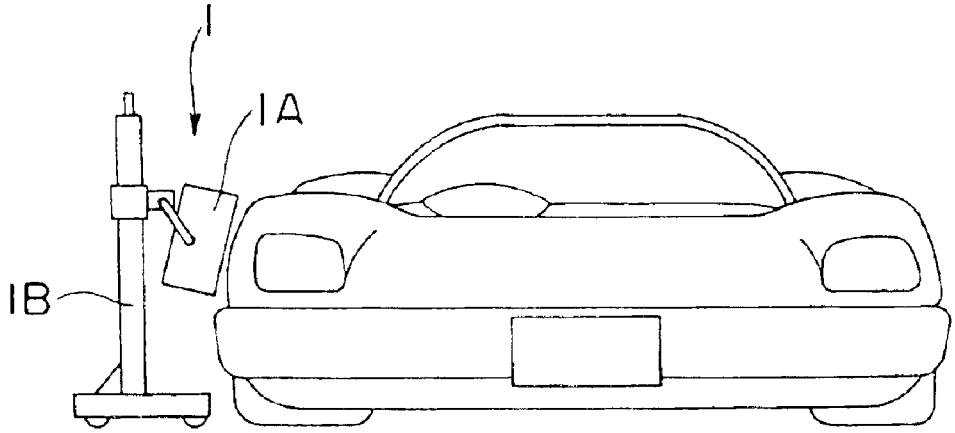
FIG. 9 is a diagram showing how a vehicle drying apparatus according to an embodiment of the present invention is used.

As shown in FIG. 9, the vehicle drying apparatus 1 of this embodiment is used in a state where the opening 43 formed in the casing 8 is close to the painted surface P. When drying the painted surface P, at a first step, the flow rate adjusting plates 46 provided in the atmospheric air inlet 44 are operated to thereby adjust the flow rate of the air introduced into the casing 8 through the atmospheric air inlet 44.

In operating the flow rate adjusting plates 46, the opening area of the atmospheric air inlet 44 is determined taking into account the room temperature. That is, when the room temperature is high as in summer, the flow rate adjusting plates 46 are opened so as to increase the amount of atmospheric air flowing in, and when the room temperature is low as in winter, the flow rate adjusting plates 46 are closed so as to reduce the amount of atmospheric air flowing in, thus adjusting the temperature inside the casing 8.

Subsequently, the above-mentioned adjuster 70 is operated so as to adjust the passage width T of the circulation path 4. That is, in this process, the adjuster 70 is operated to set the air circulation rate in the casing 8 to a desired value.

When setting the circulation rate, property of the paint applied to the painted surface P is taken into account. For example, in the case of a paint which is low in solvent content and in which all the solvent in the paint is evaporated in a relatively short period of time, the passage width T is made large and the temperature of the circulation flow is set relatively high. In the case of a paint which is high in solvent content and in which it takes a lot of time for the solvent to evaporate, the passage width is made small, and the temperature of the circulation flow is set relatively low. In this manner, the circulation rate suitable for property of respective paints is set.

An optimum circulation rate for the paint can be roughly found out through various kinds of preliminary experiments, etc. Thus, when the passage width T is set on the basis of the results of the preliminary experiments, even an operator unfamiliar with the operation of the vehicle drying apparatus 1 of this embodiment can obtain an appropriate circulation rate.

Subsequently, the drying apparatus main body 1A is operated. First, the timer is operated so as to set the illumination time for the infrared lamps 2. Thus, the period during which infrared rays are applied to the painted surface P is determined by the timer (step 101). Then, a turn-on switch 10*d* for the infrared lamps 2 is operated to turn on the infrared lamps 2, which causes the timer to start counting (steps 102 and 103).

The infrared rays emitted by turning on the infrared lamps 2 are applied to the painted surface P through the opening 24. In this process, the infrared rays emitted from the infrared lamps 2 undergo irregular reflection inside the inner casing 20, with the result that they are applied to the entire painted surface P with a substantially uniform intensity. The painted surface P irradiated with the infrared rays absorbs the radiation energy of the infrared rays, and heating is started from the inner side of the painted surface P.

Subsequently, in the control system, there is made a judgment as to whether the radiation intensity of the infrared lamps 2 has reached a predetermined level or not, on the basis of the time elapsed since the start of infrared radiation (i.e., from the time at which the infrared lamps are turned on) (step 104). That is, when the timer has counted to a predetermined time, the CPU determines that the infrared lamps 2 have reached a predetermined intensity, and the procedure advances to step 105, where the electric fans 3 are operated. When in step 104 the predetermined time has not been reached yet, it is determined that the radiation intensity of the infrared lamps 2 has not attained a predetermined level yet, and the preheating operation (warming up) of the infrared lamps 2 is continued.

Next, in step 105, power is supplied to the electric fans 3, and the air behind the inner casing 20 is blown toward the painted surface P through the air inlets 25. In step 105, the air volume of the electric fans 3 is adjusted on the basis of the output value of the temperature sensor 6 supported in the vicinity of the painted surface P. Incidentally, the feedback control for the air volume control of the electric fans 3 will be described in detail below.

Further, in this case, the painted surface P absorbs the radiation energy of the irradiated rays and causes the solvent to be evaporated, the solvent being immediately dissipated from the painted surface P by the air flow generated by the electric fans 3. As a result, evaporation of the subsequent solvent is promoted on the painted surface P.

Subsequently, in step 106, at the time simultaneous with the operation of the electric fans 3, power is supplied to the electric motors to swing (rotate) the current plates 27. Thus, the air blown toward the painted surface P by the electric fans 3 is blown substantially uniformly toward the entire painted surface P.

The air sent to the painted surface P moves along the painted surface P and passes between the painted surface P and the casing 8 to be discharged to the exterior of the casing 8. It is to be noted, however, that, as stated above, the circulation path 4 (predetermined gap) is formed between the outer casing 40 and the inner casing 20. Thus, a part of the air in the inner casing 20 to be discharged to the exterior of the casing 8 flows into the circulation path 4 and is guided to a position behind the inner casing 20.

Then, this air is sucked in again by the electric fans 3 together with the air flowing in through the atmospheric air inlet 44, and is blown toward the painted surface P side. That is, as a result of the operation of the electric fans 3, there is formed in the casing 8 a circulation flow routed as follows: electric fans 3→painted surface P→circulation path 4→behind the inner casing 20→electric fans 3→painted surface P.

The circulation flow formed in the casing 2, which absorbs the radiation heat from the painted surface and the heat energy radiated from the infrared lamps, undergoes a rise in temperature, whereas the air blown toward the painted surface P again by way of the circulation path 4, which is mixed with the air (atmospheric air) sucked in through the atmospheric air inlet 44, undergoes a drop in temperature. As a result, the temperature of the air blown again toward the painted surface P is maintained substantially at the same level as that of the air previously blown, and it is possible to prevent formation of an unnecessary coating film due to excessive temperature rise in the painted surface P.

This will be explained in more detail. The flow rate of the air flowing down the circulation path 4 and guided to the electric fans 3 is restricted through adjustment by the adjuster 70. That is, when the adjuster 70 is contracted, the amount of air supplied byway of the atmospheric air inlet 44 increases, and the temperature of the air blown toward the painted surface P is lowered accordingly. Thus, in the vehicle drying apparatus 1 of this embodiment, it is possible to maintain the temperature in the casing 8 substantially at a fixed level by operating the adjuster 70 to adjust the circulation rate of the air.

On the other hand, when the adjuster 70 is extended to enlarge the passage width T, the air circulation rate in the casing 2 becomes higher. As a result, the amount of air supplied to the electric fans 3 by way of the circulation path 4 increases. Thus, the ratio of the amount of air supplied to the electric fans 3 by way of the circulation path 4 to the amount of air supplied by way of the atmospheric air inlet 44 changes, with the result that the temperature of the air blown toward the painted surface P becomes higher.

Next, in the CPU, a judgment is made as to whether the passing time counted by the timer has reached a predetermined time or not (step 107). When it is determined that the counting of the timer has reached the predetermined time, the painted surface P is regarded as dried, and the infrared lamps 2 are turned off (step 108). When it is determined in step 107 that the predetermined time has not been reached yet, the application of infrared rays to the painted surface P is continued. That is, in step 107, the degree of drying of the painted surface P is judged by using the counting by the timer as a trigger.

After turning off the infrared lamps 2, the CPU operates the electric fans 3 continuously for a predetermined period of time in order to cool the infrared lamps 2 (step 109), and the power supply to the electric fans 3 is cut off (step 110).

In this way, in the vehicle drying apparatus 1 of this embodiment, the infrared rays emitted from the infrared lamps 2 act uniformly on the entire painted surface P while undergoing irregular reflection in the casing 8. Further, the infrared rays heat the painted surface P from inside thereof, with the result that the bonding of the pigment in the painted surface P is promoted. At the same time, the solvent contained in the paint is quickly evaporated to the exterior of the painted surface P.

At this time, the solvent actively evaporated from the paint is quickly dissipated by the circulation flow generated by the electric fans 3. Further, while the air circulating in the casing 8 absorbs the radiation heat of the painted surface, etc. to gradually undergo temperature rise, an excessive temperature rise of the air blown toward the painted surface P is prevented by operating the adjuster 70 to adjust the air circulation rate in the casing 2 to an appropriate value. Thus, unnecessary heating (drying) of the painted surface is prevented, and an ideal drying condition is achieved.

While in the above-described example the changing of the air circulation rate in the casing 8 is effected mainly through operation of the adjuster 70, the adjustment of the circulation rate can also be effected by actively adjusting the flow rate of the air flowing in through the atmospheric air inlet 44. That is, it is possible to change the rate of air supplied to the electric fans 3 by enlarging or contracting the opening area of the atmospheric air inlet 44.

This will be illustrated in more detail. When the temperature of the air supplied to the painted surface is high, the opening area of the atmospheric air inlet 44 is enlarged to increase the amount of atmospheric air supplied to the electric fans 3. When the temperature of the air supplied to the painted surface is low, the opening area of the atmospheric air inlet 44 is contracted to reduce the amount of atmospheric air supplied to the electric fans 3, whereby it is possible to change the air circulation rate in the casing 8. That is, the flow rate adjusting plates 46 provided in the atmospheric air inlet 44 also function as the flow rate adjusting mechanism of the present invention.

Figure 11:
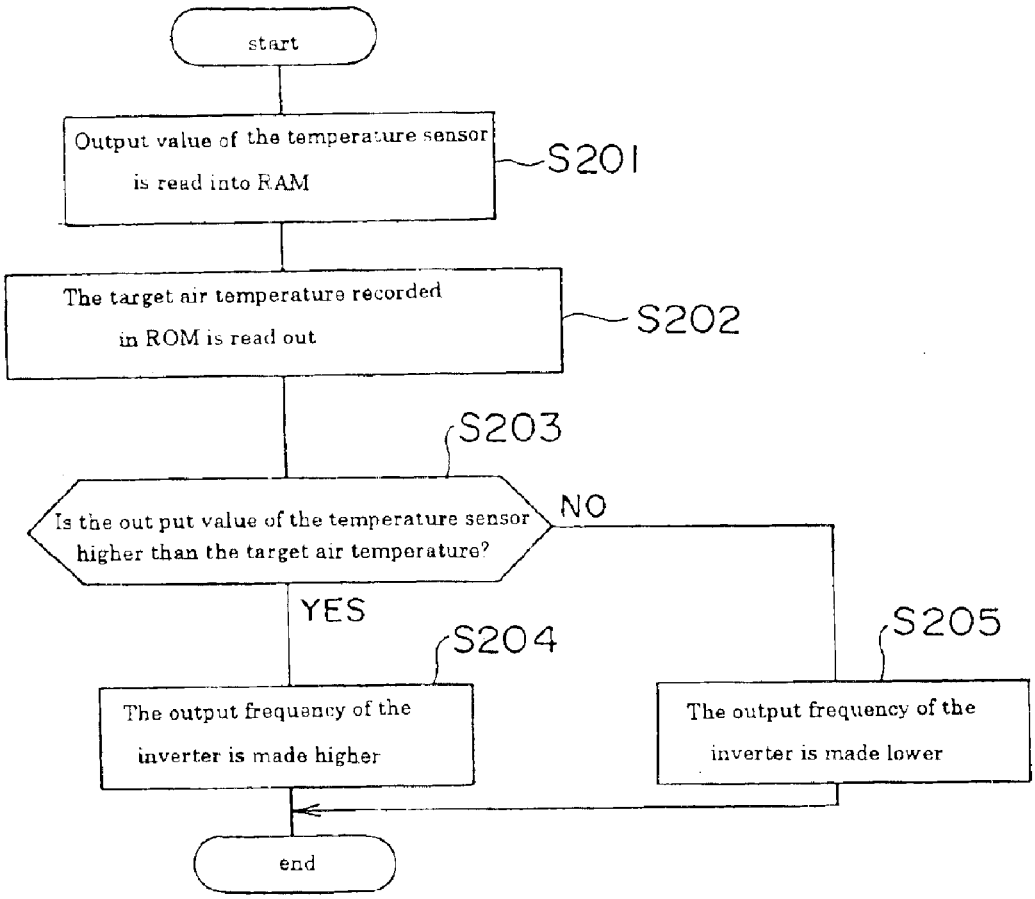
FIG. 11 is a flowchart for illustrating feedback control executed with air volume control of an electric fan according to an embodiment of the present invention.

Next, the feedback control executed in step 105 will be described. Incidentally, FIG. 11 is a flowchart for illustrating the feedback control related to the air volume control of the electric fans 3, and this processing routine is continuously executed until the processing in step 105 is completed.

Regarding this feedback control, the temperature detected by the temperature sensor 6 is the temperature of the air supplied to the painted surface P, whereas the surface temperature of the painted surface P fluctuates substantially in proportion to the output value of the temperature sensor 6. Thus, when the output value of the temperature sensor 6 is substantially maintained at a fixed level, the surface temperature of the painted surface P is accordingly maintained at a substantially fixed level. In the following, the feedback control for the air volume control of the electric fans 3 will be illustrated with reference to the flowchart of FIG. 11.

First, in the CPU, the output value of the temperature sensor 6 is read into the RAM (step 201). Subsequently, a target air temperature previously recorded in the ROM is read out (step 202), and the output value of the temperature sensor 6 recorded in the RAM and the target air temperature are compared with each other to make a judgment as to whether the output value of the temperature sensor 6 is higher than the target air temperature or not (step 203). Incidentally, the target air temperature is a value sufficiently small as compared with the surface temperature of the painted surface P, and can be arbitrarily set in advance.

Then, when in step 203 it is determined that the output value of the temperature sensor 6 is higher than the target air temperature, the output frequency of the inverter is made higher to increase the air volume of the electric fans 3 (step 204). On the other hand, when it is determined that the output value of the temperature sensor 6 is lower than the target air temperature, the output frequency of the inverter is lowered to reduce the air volume of the electric fans 3 (step 205).

Note that, when the air volume of the electric fans 3 is increased, a large amount of atmospheric air flows into the casing 2 through the atmospheric air inlet 44, and the temperature of the air supplied to the painted surface is lowered. Thus, an excessive temperature rise in the painted surface P is restrained. On the other hand, when the air volume of the electric fans 3 is reduced, the flow rate of the atmospheric air flowing into the casing 2 is also reduced, and the temperature of the air supplied to the painted surface rises. Thus, an excessive cooling of the painted surface P is restrained.

Note that, it is desirable for the adjustment of the temperature of the air in the casing 8 to be effected through the operation of the adjuster 70 described above, and this feedback control is one of the controls for attaining a more accurate temperature control.

In this way, in the vehicle drying apparatus 1 of this embodiment, the temperature of the air supplied to the painted surface P is monitored by the temperature sensor 6, and, by using the output value thereof for the feedback control of the air volume adjustment of the electric fans 3, the temperature control of the painted surface P can be effected more accurately. The above sequence control and feedback control have only been described by way of example, and they allow arbitrary modification.

Next, the support rack 1B supporting the casing 8 will be described.

The support rack 1B facilitates the application of the infrared rays to the painted surface P, and supports the casing 8 (drying apparatus main body 1A) at an arbitrary height and in an arbitrary direction.

This support rack 1B is equipped with a longitudinal frame 101, a bracket 102 provided so as to be vertically slidable on the longitudinal frame 101, a lateral frame 103 held so as to be slidable in the horizontal direction of the bracket 102, and a support arm 106 extending from the lateral frame 103 and swingably supporting the casing 8.

Further, inside the longitudinal frame 101, there is provided a balance weight 107, reducing the requisite force for vertically moving the casing 8. More specifically, there are provided, as shown in FIG. 1, a chain 108 one end of which is fixed to the apex portion of the longitudinal frame 101 and the other end of which is connected to the bracket 102, the balance weight 107 provided in the longitudinal frame 101 so as to be capable of ascending and descending, a movable pulley 107*a* mounted to the balance weight 107, and a stationary pulley 101*a* provided at the apex portion of the longitudinal frame 101. As shown in FIG. 1, the chain 108 is stretched between the bracket 102 and the apex portion of the longitudinal frame 101 through the intermediation of the movable pulley 107*a* and the stationary pulley 101*a*.

Between the balance weight 107 and the lateral frame 103 including the entire casing, etc., there is generated a boosting action depending upon the arrangement of the pulleys 107*a* and 101*a*. Therefore, when the weight of the balance weight is set to be ½ with respect to the total weight of the lateral frame including the entire casing 8, etc., the balance weight 107 and the lateral frame 103 including the casing 8, etc. are in a balanced-state in weight, facilitating the vertical movement of the casing 8.

A bottom frame 109 is connected to the lower end of the longitudinal frame 101, and casters 110 are provided in the four corners of the bottom frame 109. Thus, the apparatus 1 can be freely moved in a repair shop.

While in the above-described embodiment the present invention is applied to a vehicle drying apparatus, the drying apparatus of the present invention naturally proves useful in other applications. Further, the structure of the drying apparatus main body 1A and the structure of the support rack 1B have only been shown as an embodiment of the present invention, and they allow arbitrary modifications.

For example, while in the above-described drying apparatus 1 the air circulation rate in the casing 8 is set by using the adjuster 70, the air circulation rate in the casing 8 can also be changed by providing a detachable spacer between the inner casing 20 and the outer casing 40 and appropriately changing the thickness of the spacer as desired. Further, it is also possible to provide a strip-like valve element in the gap formed between the inner casing 20 and the outer casing 40, adjusting the flow rate of the air flowing through the circulation path 4 through operation of this valve element.

While in the above embodiment the infrared lamps 2 are adopted as the infrared radiation device, it is also possible to use infrared heaters or the like instead of the infrared lamps 2. Further, while the infrared lamps 2 are arranged in a plane parallel to the top plate 21 as described above, it is also possible, for example, to arrange a planar infrared heater or the like on the inner wall surface of the inner casing 20 to thereby form an infrared radiation portion. Further, it is also possible to effect embossment in the inner wall surface of the inner casing 20 to thereby enhance the infrared rays reflection efficiency.

As described above, in accordance with this embodiment, it is possible to provide a vehicle drying apparatus which substantially shortens the requisite time for drying the painted surface and which helps to obtain a high-quality painted surface.

The above-described embodiment of the present invention should not be construed restrictively. Any person skilled in the art can effect various modifications without departing from the scope of the invention as set forth in the claims.

INDUSTRIAL APPLICABILITY

The drying apparatus of the present invention is particularly suitable for use as an apparatus for drying paint or the like applied to a vehicle body when repairing a vehicle. Further, the drying apparatus of the present invention is also applicable to various objects other than vehicles, such as a painted surface of a piece of furniture and a painted wall surface of a building.

What is claimed is:

1. A drying apparatus characterized by comprising: a casing having an opening at one end; an infrared radiation device for radiating infrared rays toward a painted surface through the opening; a blower for blowing air in the casing toward the painted surface through the opening; a circulation path for causing at least a part of the air blown toward the painted surface by the blower to be blown toward the painted surface again; an atmospheric air inlet for introducing atmospheric air into the casing; and a flow rate adjusting mechanism for adjusting the flow rate of the air flowing into the casing again by way of the circulation path.

2. A drying apparatus according to claim 1, characterized in that the flow rate adjusting mechanism enlarges and contracts the passage section of the circulation path to thereby effect flow rate adjustment on the air flowing through the circulation path.

3. A drying apparatus according to claim 1, characterized in that the casing comprises: an inner casing having a built-in infrared radiation device to form an infrared radiation portion; an outer casing wrapping up the inner casing from outside while maintaining a predetermined gap between the outer casing and the surface of the inner casing; and a communication path communicating the predetermined gap with the space inside the inner casing, wherein the predetermined gap constitutes a part of the circulation path.

4. A drying apparatus according to claim 3, characterized in that the flow rate adjusting mechanism includes an extendable adjuster connecting the inner casing and the outer casing to each other, the passage section of the circulation path being expanded and contracted by varying the total length of the adjuster.

5. A drying apparatus according to claim 1, characterized in that the atmospheric air inlet is provided in a route of the circulation path, and that the flow rate adjusting mechanism enlarges and contracts the opening area of the atmospheric air inlet, the flow rate of the air flowing into the casing again by way of the circulation path being adjusted.

6. A drying apparatus according to claim 1, characterized in that the flow rate adjusting mechanism comprises: a temperature detection sensor for detecting the temperature of the air blown toward the painted surface; and a control device for performing air amount adjustment for the blower on the basis of the air temperature detected by the temperature detection sensor, and that the control device increases the output of the blower when the temperature detected by the temperature sensor is higher than a target air temperature and decreases the output of the blower when the temperature detected by the temperature sensor is lower than the target temperature.

7. A drying apparatus according to claim 1, characterized in that the infrared rays emitted from the infrared radiation device has a wavelength range including a range of 2.5 1 $\mu$m to 14.0 $\mu$m.

8. A drying apparatus according to claim 1, characterized in that the peak of the radiation energy of the infrared rays emitted from the infrared radiation device is in a wavelength range of 3.0 $\mu$m to 4.0 $\mu$m.

9. A drying apparatus according to claim 1, characterized in that the peak of the radiation energy emitted from the infrared radiation device is in a wavelength range of 5.5 $\mu$m to 10.0 $\mu$m.

10. A drying apparatus according to claim 1, characterized by further comprising a support rack for supporting the casing which has a longitudinal frame and a lateral frame slidably held by the longitudinal frame, the casing being swingably held by the lateral frame.

* * * * *